US007354358B2

(12) United States Patent
Kasashima et al.

(10) Patent No.: US 7,354,358 B2
(45) Date of Patent: Apr. 8, 2008

(54) GOLF BALL

(75) Inventors: Atsuki Kasashima, Chichibu (JP); Katsunori Sato, Chichibu (JP)

(73) Assignee: Bridgestone Sports Co., Ltd., Tokyo (JP)

( * ) Notice: Subject to any disclaimer, the term of this patent is extended or adjusted under 35 U.S.C. 154(b) by 0 days.

(21) Appl. No.: 11/181,868

(22) Filed: Jul. 15, 2005

(65) Prior Publication Data

US 2007/0015609 A1 Jan. 18, 2007

(51) Int. Cl.
*A63B 37/12* (2006.01)

(52) U.S. Cl. ..... 473/383

(58) Field of Classification Search ..... 473/383–385
See application file for complete search history.

(56) References Cited

U.S. PATENT DOCUMENTS 1,681,167 A * 8/1928 Beldam ..... 473/383
4,090,716 A * 5/1978 Martin et al. ..... 473/379
4,830,378 A * 5/1989 Aoyama ..... 473/384
6,290,615 B1 9/2001 Ogg
7,128,666 B2 * 10/2006 Veilleux et al. ..... 473/384
2005/0227787 A1 * 10/2005 Ogg et al. ..... 473/378

FOREIGN PATENT DOCUMENTS

JP 2003-47674 A 2/2003

* cited by examiner

*Primary Examiner*—Raeann Trimiew
(74) *Attorney, Agent, or Firm*—Sughrue Mion, PLLC

(57) ABSTRACT

A golf ball has a plurality of polygonal dimples, each with an interior wall that includes areas formed by a plurality of flat surfaces. The ball retains a good carry without a decline in flight performance. In addition, the many novel and distinctive dimples formed on the surface of the ball cause it to glitter from the irregular reflection of light by the dimples, imparting to the ball an attractive appearance that makes it highly desirable to the consumer.

9 Claims, 2 Drawing Sheets

GOLF BALL

BACKGROUND OF THE INVENTION

The present invention relates to a golf ball characterized by having an aesthetically pleasing appearance while retaining an excellent flight performance.

It is known that when an object having many recesses on a spherical surface, such as a golf ball, flies through the air, airflow turbulence generally arises around the object. That is, when an object having a complex spherical shape rotates while in flight, airflow turbulence during flight is complicated and affects flight performance, including the distance traveled by the object. In this connection, most golf balls have formed on the surface thereof dimples which have a shape when viewed as a flat plane from directly above (sometimes referred to below as a "top plan view") that is circular, and have a cross-sectional shape that describes a circular arc or a similar curved line. In other words, the inner walls of the dimples are formed as concave curved surfaces.

In addition to dimples like the above which have a planar shape that is circular, polygonal dimples having what is basically a hexagonal shape are disclosed in JP-A 2003-47674.

In this prior-art disclosure, the dimple shape is one in which the planar shape of the dimple opening where it meets land areas on the golf ball is hexagonal, but the inner wall portion of the dimple is formed as a substantially concave curved surface. In addition, U.S. Pat. No. 6,290,615 describes a golf ball having hexagonal dimples. The dimples differ from ordinary dimples in that they consist of hexagonal lattice patterns formed on a sphere by a plurality of tubular projections. The tubular projections have a cross-sectional shape that is arcuate, and so each inner wall portion of a hexagonal lattice pattern forms a curved surface.

However, the orientation of the sides on the hexagonal dimples affects the direction of flight by this prior-art golf ball; the carry of the ball and its direction of flight may differ depending on whether the direction of flight agrees with or differs from the orientation of the hexagonal sides of the dimples.

SUMMARY OF THE INVENTION

It is therefore an object of the invention to provide a golf ball which has a flight performance comparable with that of golf balls having such circular dimples or other, non-circular, dimples while at the same time providing the ball when played with an aesthetic appeal that is novel and engenders in the consumer a desire to purchase the ball.

As a result of extensive investigations, we have focused our attention on the shape of the numerous dimples that are provided on the surface of the ball and have succeeded in forming the interior walls of the dimples from numerous flat surfaces. In particular, we have been successful in making the surface of the ball glitter due to irregular reflection when it receives direct sunlight, thus endowing the ball with a novel and attractive appearance that creates in the consumer a desire to buy the ball, while at the same time preventing a decline in the flight performance and retaining a good carry.

Accordingly, the invention provides the following golf balls.

[1] A golf ball having a plurality of dimples with a planar shape that is polygonal, the golf ball being characterized in that each dimple has an interior wall which includes areas composed of a plurality of flat surfaces.

[2] The golf ball of [1] above, wherein the flat surfaces are defined by a first contour, which is of a polygonal shape in a top plan view and defines a peripheral edge of the dimple, in combination with additional contours formed by at least two stepped reductions of the first contour toward a bottom of the dimple

[3] The golf ball of above, wherein the bottom of the dimple is a polygonal flat surface.

[4] The golf ball of [1]above, wherein the polygonal planar shape of the dimples is selected from among polygons having eight to sixteen sides.

BRIEF DESCRIPTION OF THE DIAGRAMS

DETAILED DESCRIPTION OF THE INVENTION

The invention is described more fully below in conjunction with the above diagrams.

Figure 1:
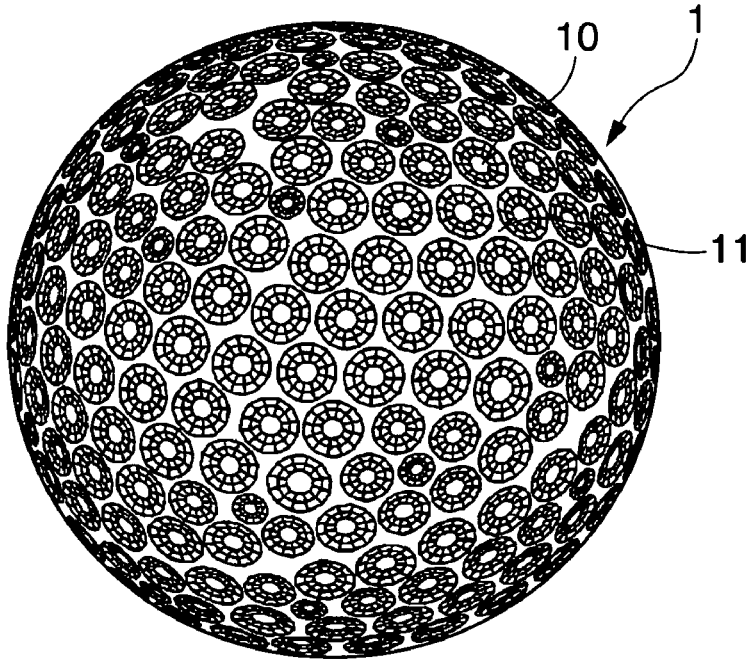
FIG. 1 is a plan view of a golf ball according to one embodiment of the invention.
Figure 2:
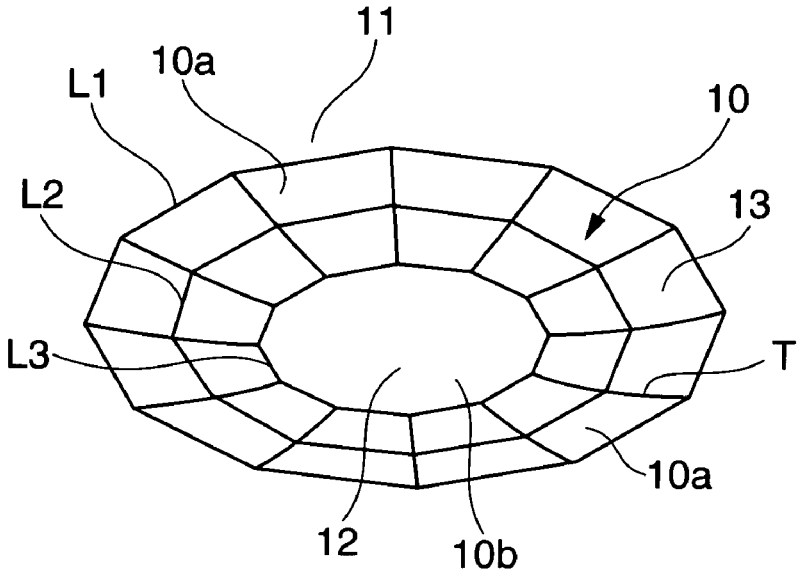
FIG. 2 is an enlarged perspective view illustrating the shape of a dimple on the surface of the golf ball in FIG. 1.
Figure 3:
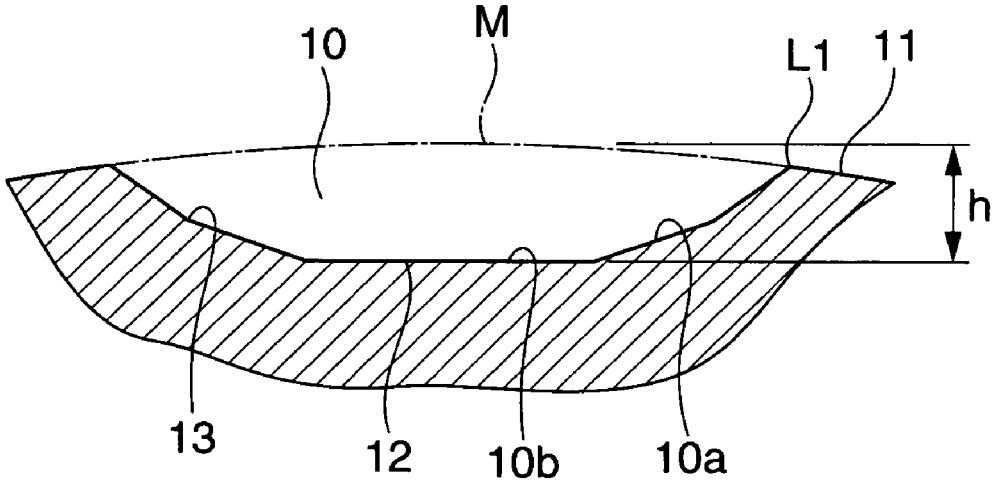
FIG. 3 is an enlarged cross-sectional view of a dimple and its vicinity on the surface of the golf ball in FIG. 1.

FIG. 1 is a plan view of a golf ball according to one embodiment of the invention, FIG. 2 is an enlarged perspective view of one of the dimples arranged on the golf ball in FIG. 1, and FIG. 3 is a cross-sectional view passing through the center of such a dimple.

Referring to FIGS. 1 and 2, in FIG. 1, a golf ball 1 has a spherical surface on which a plurality of dimples 10 are arranged by an ordinary method. Each dimple 10 has a planar shape that is polygonal. That is, each dimple 10 as seen in a top plan view is a polygon. The dimples 10 in FIG. 1 are regular dodecagons. Each dimple has an interior wall 13 composed of a plurality of flat surfaces 10*a*.

As shown in FIG. 2, the plurality of flat surfaces 10*a* are defined by a contour which is of a polygonal planar shape (first contour L1) and represents a dimple peripheral edge situated at the boundary of the dimple with a land area 11, and by two contours (second contour L2 and third contour L3) formed by two stepped reductions of the first contour L1 at least two times toward a bottom 12 of the dimple. In FIG. 2, the second contour L2 and the third contour L3 are mutually parallel, and there are twelve individual dividing lines T which perpendicularly intersect the first, second and third contours. Each of the flat surfaces 10*a* defined by the three parallel contours (L1, L2, L3) and the twelve dividing lines T perpendicular to these contours has an inverted trapezoidal shape oriented toward the center of the dimple. Moreover, the bottom 12 of the dimple 10 is surrounded by the third contour L3 and shaped as a dodecagonal flat surface 10*b*.

In this embodiment, a single dimple is formed by 24 trapezoidal flat surfaces 10*a* and a single dodecagonal flat surface 10*b* that serves as the bottom of the dimple.

Next, referring to FIG. 3, the distance or depth h from an imaginary extension (dash-dot line) M of the land 11 to the center of the dimple bottom in a direction oriented toward the center of the ball is preferably in a range of 0.1 to 0.4 mm. The volume of the dimple surrounded by the wall 13, including the dimple bottom 12, and by the imaginary extension M of the land 11, while not subject to any particular limitation, is generally at least 0.3 $mm^3$ but not more than 3.0 $mm^3$.

In the golf ball 1 of the invention constructed in this way, the inside wall 13 of the dimple is formed of a number of flat surfaces 10*a*, each of which is a small, smooth flat plane facing in a different direction. Hence, when light strikes these flat surfaces 10*a*, it is reflected and scattered in all directions, making the ball 1 appear even brighter.

In the invention, no particular limitation is imposed on the number of sides in the polygonal planar shape, although a shape having eight to sixteen sides is preferred. If the polygonal planar shape has less than eight sides, the carry of the ball may decrease. On the other hand, if the polygonal planar shape has more than sixteen sides, the surface area of each flat surface becomes so small that the brightness of the ball surface tends to diminish.

The total number of dimples formed on the surface of the ball can generally be set within a range of 250 to 450, and the dimples can be arranged in a good balance on the spherical surface in a known dimple pattern, such as an octahedral, dodecahedral or icosahedral arrangement. It is generally suitable to set the total volume of the dimples within a range of 400 to 700 $mm^3$.

In the invention, the dimples arranged on the surface of the ball are generally of at least two types of differing diameter and/or depth, and preferably of at least four such types. There is no particular upper limit on the number of such dimple types. When only one type of dimple is used, it may be difficult to achieve a dense arrangement of dimples. On the other hand, a larger number of dimple types entails higher production costs, giving rise to cost constraints.

Figure 4:
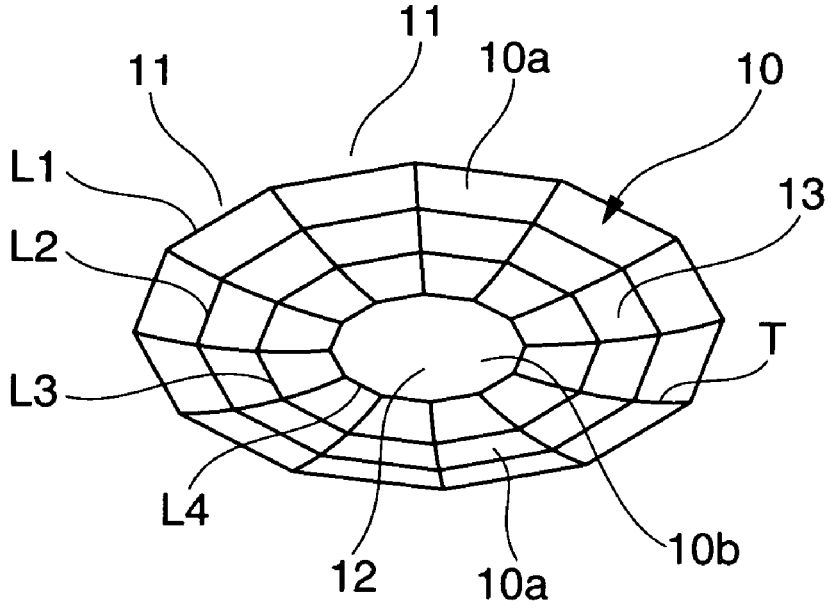
FIG. 4 is an enlarged cross-sectional view of a dimple shape which differs from that shown in FIG. 1.

FIG. 4 is a perspective view of a dimple according to a second embodiment of the invention. This dimple has a peripheral edge (referred to below as the "first contour L1") which meets the land, and also has several contours which are located inside of this first contour L1 and parallel to it; namely, a second contour L2, a third contour L3, and a fourth contour L4. This embodiment differs from the first embodiment in that the dimple reduces in three steps toward the dimple bottom 12, and has a fourth contour L4. The dimple wall 13 is divided by these contours into a total of 36 small, smooth areas. As in the first embodiment, these small areas are composed of a plurality of flat surfaces 10*a*, but because there are twelve more flat surfaces 10*a* than in the first embodiment, the surface area per flat surface 10*a* is correspondingly smaller than in the first embodiment. As in the first embodiment, the dimple bottom 12 surrounded by the fourth contour L4 is a dodecagonal flat surface 12*b*. However, because a fourth contour L4 is provided, this dimple bottom 12 has a smaller surface area than in the first embodiment.

In an exemplary method for forming the above-described dimples 10, numerous projections corresponding to the shapes of the dimples 10 are provided on the walls of the mold cavity in a golf ball mold, and dimples 10 are formed on the surface of the golf ball cover by using the mold to carry out injection molding. To fabricate such a mold, a technique may be employed in which, as is commonplace in the art, 3DCAD.CAM is used to directly cut the entire surface shape three-dimensionally into a master mold from which the golf ball mold is subsequently made by pattern reversal, or to directly cut three-dimensionally the walls of the mold cavity for the golf ball mold.

Although some preferred embodiments of the inventive golf ball have been described, many modifications and variations may be made thereto, such as in the arrangement of dimples formed on the surface of the ball, without departing from the scope of the invention. No particular limitation is imposed on other features of the inventive golf balls. For example, the golf ball may be a solid golf ball such as a one-piece golf ball, two-piece golf ball or multi-piece golf ball having three or more layers. The materials making up the various parts of the golf ball, such as the core and cover, may be suitably selected from among known rubber materials and known thermoplastic resins or elastomers such as ionomer resins, polyester elastomers and urethane resins, and adjusted to the desired thickness and hardness. The weight and diameter of the overall golf ball can be set as appropriate in accordance with the Rules of Golf, and the ball is generally formed to a diameter of not less than 42.67 mm and a weight of not more than 45.93 g.

As explained above, the golf ball of the invention has a flight performance which is comparable with that of conventional golf balls having a large number of circular dimples. At the same time, by forming a large number of novel and distinctive dimples on the ball's surface, the ball appears to glitter due to the irregular reflection of light by the dimples, giving the ball an aesthetically pleasing appearance which engenders in the consumer a desire to purchase the ball.

The invention claimed is:

1. A golf ball having a plurality of dimples with a planar shape that is polygonal, the golf ball being characterized in that each dimple has an interior wall which includes areas composed of a plurality of flat surfaces, wherein the flat surfaces are defined by a first contour, which is of a polygonal shape in a top plan view and defines a peripheral edge of the dimple, in combination with additional contours formed by at least two stepped reductions of the first contour toward a bottom of the dimple.

2. The golf ball of claim 1, wherein the bottom of the dimple is a polygonal flat surface.

3. The golf ball of claim 1, wherein a distance along a radial direction of the golf ball between an imaginary extension of a land area on an outermost surface of the golf ball and a center of each dimple bottom is within the range of 0.1 mm to 0.4 mm, inclusive.

4. The golf ball of claim 1, wherein a volume of each dimple as bounded by an imaginary extension of a land area on an outermost surface of the golf ball is within the range of 0.3 $mm^3$ to 3.0 $mm^3$, inclusive.

5. The golf ball of claim 4, wherein a total volume of all dimples on the golf ball is within a range of 400 $mm^3$ to 700 $mm^3$, inclusive.

6. A golf ball having a plurality of dimples with a planar shape that is polygonal, the golf ball being characterized in that each dimple has an interior wall which includes areas composed of a plurality of flat surfaces, wherein the polygonal planar shape of the dimples is selected from among polygons having eight to sixteen sides.

7. The golf ball of claim 6, wherein a distance along a radial direction of the golf ball between an imaginary extension of a land area on an outermost surface of the golf ball and a center of each dimple bottom is within the range of 0.1 mm to 0.4 mm, inclusive.

8. The golf ball of claim 6, wherein a volume of each dimple as bounded by an imaginary extension of a land area on an outermost surface of the golf ball is within the range of 0.3 $mm^3$ to 3.0 $mm^3$, inclusive.

9. The golf ball of claim 4, wherein the bottom of the dimple is a polygonal flat surface.

* * * * *